US005950342A

United States Patent [19]

Suesholtz

[11] Patent Number: 5,950,342

[45] **Date of Patent: *Sep. 14, 1999**

[54] FRAMES FOR PICTURES AND THE LIKE

[75] Inventor: Herbert Suesholtz, Harrison, N.Y.

[73] Assignee: Northeast Sales Organization, Harrison, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/708,657

[22] Filed: Sep. 5, 1996

Related U.S. Application Data

[63] Continuation of application No. 08/101,179, Aug. 3, 1993, abandoned.

[51] Int. Cl.[6] ..... G09F 1/12

[52] U.S. Cl. ..... 40/768; 40/773; 52/204.62

[58] Field of Search ..... 40/757, 773, 700, 40/768, 780, 594; 52/204.62, DIG. 13

[56] References Cited

U.S. PATENT DOCUMENTS

| | | | |
|---|---|---|---|
| 1,092,499 | 4/1914 | Matsuo | 40/773 |
| 1,959,745 | 5/1934 | Stout | 40/757 X |
| 3,341,961 | 9/1967 | Shanks | 40/773 |
| 3,579,886 | 5/1971 | Hughes | 40/773 |
| 4,399,625 | 8/1983 | Langan | 40/773 X |
| 4,881,333 | 11/1989 | Manrubia | 40/757 |
| 5,010,666 | 4/1991 | Robles | 40/773 |
| 5,201,133 | 4/1993 | Best et al. | 40/773 |
| 5,253,439 | 10/1993 | Shanok et al. | 40/594 X |
| 5,269,084 | 12/1993 | Best et al. | 40/773 |
| 5,328,139 | 7/1994 | Barnes | 40/757 X |

*Primary Examiner*—Brian K. Green
*Attorney, Agent, or Firm*—Hedman, Gibson & Costigan, P.C.

[57] ABSTRACT

A system for framing decorative art or mirrors with narrow frames comprising a frame assembly, a polygonal shaped planar sheet of rigid or semi-rigid material, and lateral movement preventing elements strategically located between the front face of the planar sheet and the frame assembly. The lateral movement preventing elements are strips of resilient compressible foam tape with pressure sensitive adhesive disposed on opposite sides thereof for adherence to the planar sheet and to the frame assembly. The planar sheet is thereby attached to the frame assembly at the location of each of the lateral movement preventing elements, thus providing strength to the frame assembly and preventing the lateral movement or bowing of any of the frame parts with respect to the frame assembly. In bonding the planar surface to the strips, the weight of the planar surface is borne mostly by the strips instead of the mitered joints, greatly reducing the tendency for mitered joints to be separated.

2 Claims, 3 Drawing Sheets

FRAMES FOR PICTURES AND THE LIKE

This is a continuation of application Ser. No. 08/101,179, filed Aug. 3, 1993, now abandoned.

FIELD OF THE INVENTION

This invention relates to frames for pictures, mirrors and other framed items, and in particular to a method of providing strength to such frames made from narrow members which would otherwise flex and bow under pressure.

BACKGROUND OF THE INVENTION

Frames for decorative art, mirrors, posters and like may be formed from a plurality (usually four) of sides, or frame parts, which are joined to each other at mitered ends. These frame parts are often made from stock which is relatively narrow. Such narrow frame parts have exhibited tendencies in the past to flex or bow when subjected to a heavy force, or the mitered frame joints may pull apart. For example, if a planar sheet of glass is disposed between the frame and the underlying artwork, and the frame is hung by hanging means attached to the back of the top frame part, the weight of the glass and frame can cause the top frame part to bow undesirably. Such lateral movement of the frame parts is observed notwithstanding a tightly joined miter at each corner; that is, the bowing may occur solely due to the tendency of the narrow frame part to bend under stress.

Such bowing has been observed in narrow frame parts made from metal, composites such as plastics, and wood.

In addition, it has been observed that the frame joints may open and even come apart when subjected to heavy stress.

To overcome these problems, frames of the prior art have been manufactured with straps of plastic, wire or cardboard to prevent the sides from pulling apart, as shown in FIG. 1. This arrangement may not, however, prevent the sides from flexing inwardly. Also, it is not effective in preventing the mitered joints from separating slightly.

Another prior art method is shown in FIG. 2, where wire is threaded through screw eyes located on each side of the frame and pulled together with the ends twisted together. This has similar problems.

In addition, with frames comprised of an inner frame (strainer) and an outer frame, nails can be inserted on all four sides to join the inner and outer frames.

The above described prior art methods of providing strength to frames are expensive to manufacture and often do not provide the desired effectiveness.

It is thus desirable to provide to a frame made from narrow frame parts means to prevent undesirable lateral movement of the frame parts or separation of the mitered joints.

It is further desired to provide such means which are inexpensive, simple to implement, and can be utilized with various sized and shaped frames already in use by the consumer.

SUMMARY OF THE INVENTION

In accordance with these and other objects, provided is a system for framing decorative art or mirrors with narrow frames comprising a polygonal, preferably rectangular, shaped planar sheet of rigid or semi-rigid material having a plurality of straight sides and having a front face and a back face; a frame assembly for framing the planar sheet, the frame assembly comprising a plurality of straight, semi-rigid narrow frame parts each extending along a respective side of the planar sheet, each having a pair of oppositely mitered ends abutting flatly with and adjoined to the corresponding ends of the neighboring frame parts, and each integrally formed with a substantially L-shaped cross-section such that a contiguous rabbet is formed around the frame assembly and facing rearwardly for receiving the front face of the planar sheet therewithin, wherein the rabbet comprises a front portion and a side portion adjoined thereto; and a plurality of lateral movement preventing means strategically located between the front face of the planar sheet and the frame assembly, the lateral movement preventing means comprising a strip of resilient compressible foam tape having pressure sensitive adhesive disposed on opposite sides thereof for adherence to the planar sheet and to the frame assembly. The planar sheet is attached to the frame assembly at the location of each of the lateral movement preventing means, thus providing strength to the frame assembly and preventing the lateral movement or bowing of any of the frame parts with respect to the frame assembly or separation of the mitered joints.

In accordance with the present invention, also provided is a method of framing decorative art or mirrors with narrow frames comprising the steps of providing a polygonal shaped planar sheet of rigid or semi-rigid material having a plurality of straight sides and having a front face and a back face; constructing a frame assembly comprised of a plurality of straight, semi-rigid narrow frame parts, each for extending along a respective side of the planar sheet, each having a pair of oppositely mitered ends abutting flatly with and adjoined to the corresponding ends of the neighboring frame parts, and each integrally formed with a substantially L-shaped cross-section such that a contiguous rabbet is formed around the frame assembly and facing rearwardly for receiving the front face of the planar sheet therewithin, wherein the rabbet comprises a front portion and a side portion adjoined thereto; and providing a plurality of lateral movement preventing means strategically between the front face of the planar sheet and the frame assembly, the lateral movement preventing means comprising a strip of resilient compressible foam tape having pressure sensitive adhesive disposed on opposite sides thereof for adherence to the planar sheet and to the frame assembly and preventing the mitered joints from separating.

DESCRIPTION OF THE PREFERRED EMBODIMENT

Figure 1:
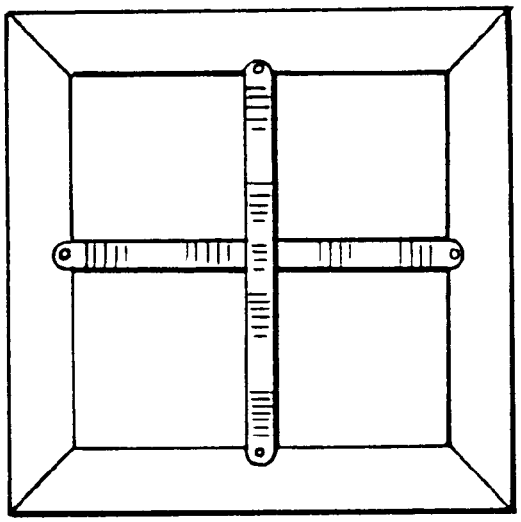
FIG. 1 (PRIOR ART)
FIG. 1 is a rear plan view of a first prior art frame.
Figure 2:
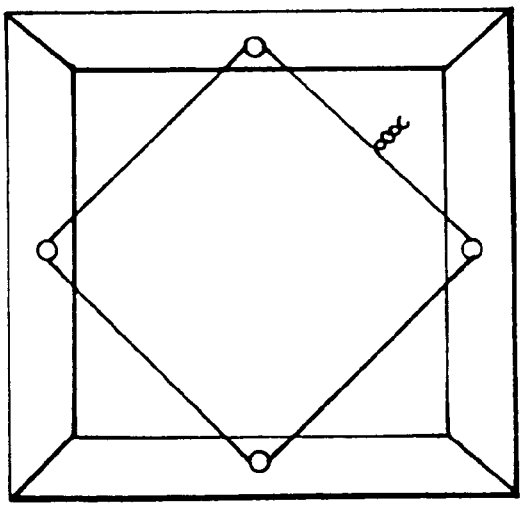
FIG. 2 (PRIOR ART)
FIG. 2 is a rear plan view of a second prior art frame.
Figure 3:
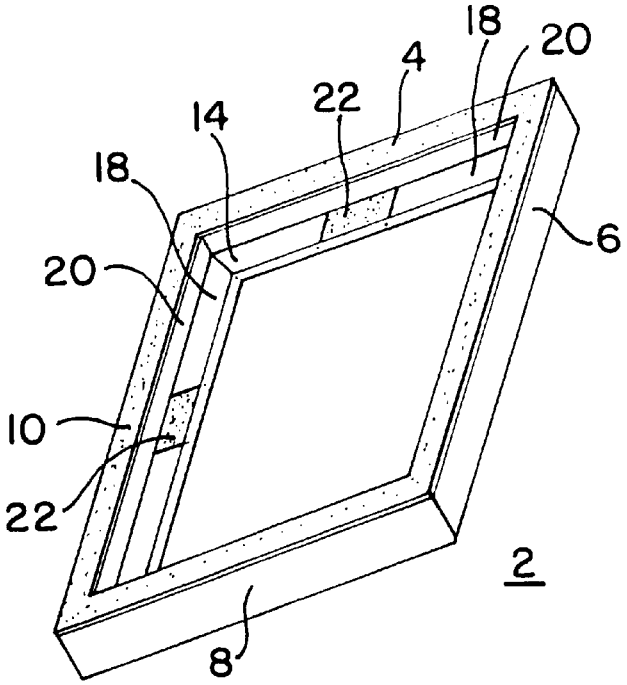
FIG. 3 is a rear perspective view of the frame assembly of the preferred embodiment of the present invention.
Figure 4:
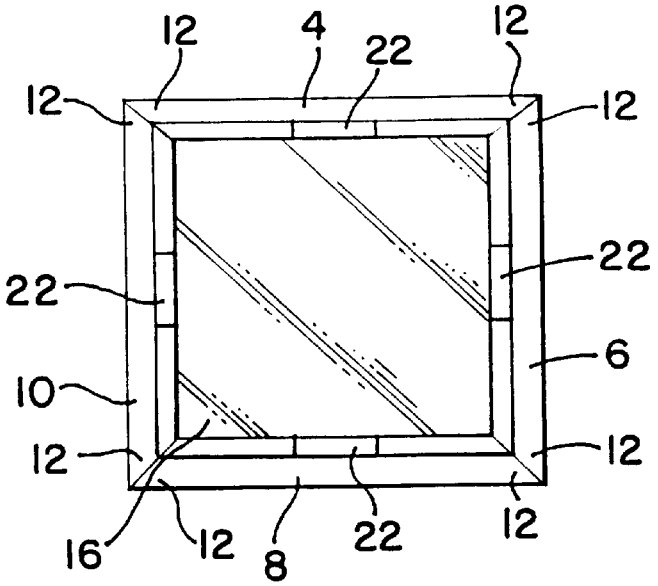
FIG. 4 shows the rear view of the frame assembly of FIG. 3 with a transparent planar sheet fully loaded.

FIGS. 3 and 4 show a preferred embodiment of the present invention, comprising rectangular shaped frame assembly 2 comprising four straight, semi-rigid narrow frame parts 4, 6, 8 and 10. Each frame part 4, 6, 8 and 10 has a pair of oppositely mitered 45° ends 12 abutting flatly with and adjoined to the corresponding ends 12 of the neighboring frame parts.

Figure 5:
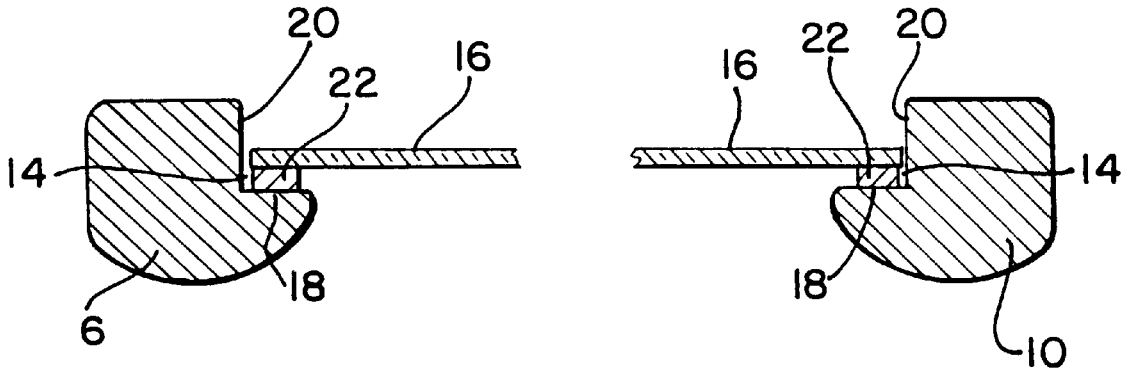
FIG. 5 is a partial cross section view of the frame assembly of FIG. 4.

Each frame part 4, 6, 8 and 10 is integrally formed with a substantially L-shaped cross-section. FIG. 5 shows this L-shaped cross section in frame parts 6 and 10. A contiguous rabbet 14 is formed around the frame assembly 2 and facing rearwardly for receiving the front face of a rectangular planar sheet 16. The rabbet comprises a front portion 18 and a side portion 20.

A plurality of lateral movement preventing means are strategically located on the front face 18 of the rabbet 14 of the frame assembly 2. In the preferred embodiment, the lateral movement preventing means are strips 22 of resilient compressible foam tape having pressure sensitive adhesive disposed on opposite sides thereof for adherence to the frame assembly 2. Usually, lengths between 3" to 6" are satisfactory, but the length can be varied for different frame dimensions. The larger the frame, the longer the strips that will be needed. By way of example, 3" strips will suffice for frames up to 20" by 24", and 6" strips will cover frames up to 30" by 40". The strips should be centered on each frame part, as shown in the figures.

A rectangular shaped planar sheet 16 of rigid or semi-rigid material, for example a transparent material such as glass or plexiglass, or a mirror or board such as masonite, is sized to fit snugly within the rabbet 14. The planar sheet 16 is attached to the frame assembly 2 by adhering to the strategically located resilient strips 22. Strength is thus provided by the planar sheet 16 to the frame assembly 2, which prevents the lateral movement or bowing of any of the frame parts 4, 6, 8, 10 with respect to the frame assembly 2 and the planar sheet 16, and reduces the stress on the mitered joints 12.

Practice has taught that, for any given sized rabbet, the tape strips 22 must be at least 1/16" narrower than the rabbet, or else it will be visible through the transparent planar sheet. Practice has also taught that an ideal strip thickness is 1/32". Surprisingly, if the strip 22 is thicker, it is not as strong. For example, strips 22 with a thickness of 1/16" have about 20% less strength than strips 22 that are 1/32" thick.

The tape strips 22 should be applied at the centers of the frame parts in order to achieve maximum effectiveness. Moreover, it is cost effective to utilize only one strip 22 for each side, since the material cost increases with the implementation of more than one strip 22 per side as does the labor costs in applying more strips 22 than necessary.

Practice has shown that this invention eliminates completely the bowing problems of prior art frames at a lower cost and reduces the separation of the mitered joints because it bears most of the load of the item being framed, while making it possible to use any molding desired in wood, plastic, metal, or wood derivative having a rabbet width of approximately 3/16" or more. While rabbet width of 1/2" is usually the widest, the invention will work with any rabbet width.

Tapes are available commercially with the characteristics noted below that make them suitable for the present invention:

| | |
|---|---|
| Application temperature: | 65° F.–120° F. |
| Service temperature: | 0° F.–150° F. |
| Static shear* | 15 lbs/in$^2$ |
| Tensile* | 50 lbs/in$^2$ |
| Thickness | 1/32" |

*when bonding to wood, plastic, metal or wood derivatives

When the framing system of the present invention is used, the structural strength of the frame is increased by the structural strength of the planar sheet to which the frame is bonded.

By bonding the planar sheet to the frame, most of the weight of the planar sheet is supported by the tape strips 22. This substantially reduces the force tending to pull the mitered joints apart, and practically eliminates failed joints.

I claim:

1. A system for framing decorative art with frames comprising;

(a) a rectangular shaped planar sheet of rigid transparent material having four straight sides and having a front face and a back face;

(b) a rectangular frame assembly for framing said planar sheet, said frame assembly comprising four separate straight semi-rigid frame parts each said frame part being at least 20 inches long and extending along a respective side of said planar sheet, each of said separate straight frame parts having a pair of oppositely mitered 45° ends abutting flatly with and adjoined to the corresponding ends of the neighboring frame parts, and each integrally formed with a substantial L-shaped cross-section such that a continuous rabbet is formed around said frame assembly which faces rearwardly for receiving said front face of said planar sheet therewithin, said continuous rabbet having an end point at each of said corresponding ends of the neighboring frame parts, wherein said rabbet comprises a front portion facing rearwardly and a side portion adjoined thereto, and said front portion of said rabbet is 3/16 or more inches wide, said rectangular frame assembly being adapted to be hung on a wall with a hanger on at least one of said four separate straight frame sides; and (c) only one strip of compressible foam tape centered on each of said four frame parts, each of said one strip of compressible foam tape having pressure sensitive adhesive disposed on opposite sides thereof for adherence to said planar sheet and to said frame assembly, each of said strips of foam tape having a length of from 3 to 6 inches and being disposed between said front face of said planar sheet and said frame assembly at each midpoint of each of said frame parts, each of said strips of foam tape being spaced from the ends of the rabbet upon which it is attached;

said planar sheet is attached to said frame assembly at the location of each of said strips of foam tape supporting said planar sheet on said strips, thus providing strength to said frame assembly and preventing the lateral movement or bowing of any of said frame parts with respect to said frame assembly, and preventing the mitered joints from separating.

2. A system for framing decorative art with frames comprising;

(a) a rectangular shaped planar sheet of rigid transparent material having four straight sides and having a front face and a back face;

(b) a rectangular frame assembly for framing said planar sheet, said frame assembly comprising four separate straight semi-rigid frame parts each said frame part being at least 20 inches long and extending along a respective side of said planar sheet, each of said separate straight frame parts having a pair of oppositely mitered 45° ends abutting flatly with and adjoined to the corresponding ends of the neighboring frame parts, and each integrally formed with a substantial L-shaped cross-section such that a continuous rabbet is formed around said frame assembly and which faces rearwardly for receiving said front face of said planar sheet therewithin, said continuous rabbet having end points at each of said corresponding ends of the neighboring frame parts wherein said rabbet comprises a front portion facing rearwardly and a side portion adjoined thereto, and said front portion of said rabbet is 3/16 or more inches wide, said rectangular frame assembly being adapted to be hung on a wall with a cable attached to opposite sides of said rectangular frame; and (c) only one strip of compressible foam tape centered on each of said four frame parts, each of said one strip of compressible foam tape having pressure sensitive adhesive disposed on opposite sides thereof for adherence to said planar sheet and to said frame assembly, each of said strips of foam tape having a length of from 3 to 6 inches and being disposed between said front face of said planar sheet and said frame assembly at each midpoint of each of said frame parts, each of said strips of foam tape being spaced from the ends of the rabbet upon which it is attached;

said planar sheet is attached to said frame assembly at the location of each of said strips of foam tape supporting said planar sheet on said strips, thus providing strength to said frame assembly and preventing the lateral movement or bowing of any of said frame parts with respect to said frame assembly, and preventing the mitered joints from separating.

* * * * *